US007588737B2

(12) United States Patent
Stell et al.

(10) Patent No.: US 7,588,737 B2
(45) **Date of Patent: *Sep. 15, 2009**

(54) PROCESS AND APPARATUS FOR CRACKING HYDROCARBON FEEDSTOCK CONTAINING RESID

(75) Inventors: Richard C. Stell, Houston, TX (US); George J. Balinsky, Kingwood, TX (US); James N. McCoy, Houston, TX (US); Paul F. Keusenkothen, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 235 days.

This patent is subject to a terminal disclaimer.

(21) Appl. No.: 11/522,137

(22) Filed: Sep. 15, 2006

(65) Prior Publication Data

US 2007/0009407 A1 Jan. 11, 2007

Related U.S. Application Data

(62) Division of application No. 10/851,486, filed on May 21, 2004, now Pat. No. 7,220,887.

(51) Int. Cl.
*B01J 10/00* (2006.01)
*C07C 4/02* (2006.01)

(52) U.S. Cl. ..... 422/188; 422/187; 585/648

(58) Field of Classification Search ..... 422/188, 422/187; 585/648
See application file for complete search history.

(56) References Cited

U.S. PATENT DOCUMENTS 1,710,178 A * 4/1929 McMurray ..... 96/192
1,936,699 A 11/1933 Weaver ..... 196/116
1,984,569 A 12/1934 Cooke et al. ..... 196/66
2,091,261 A 8/1937 Alther ..... 196/49
2,158,425 A 5/1939 Ragarz ..... 196/73
2,366,521 A * 1/1945 Guichet ..... 208/48 R
2,893,941 A * 7/1959 Kohfeldt et al. ..... 208/48 R
3,291,573 A 12/1966 Frescoln ..... 23/284

(Continued)

FOREIGN PATENT DOCUMENTS

DE 1093351 11/1960

(Continued)

OTHER PUBLICATIONS

Dennis A. Duncan and Vance A. Ham, Stone & Webster, "The Practicalities of Steam-Cracking Heavy Oil", Mar. 29-Apr. 2, 1992, AIChE Spring National Meeting in New Orleans, LA, pp. 1-41.

(Continued)

*Primary Examiner*—Walter D Griffin
*Assistant Examiner*—Natasha Young

(57) ABSTRACT

A process for cracking hydrocarbon feedstock containing resid comprising: heating the feedstock, mixing the heated feedstock with a fluid and/or a primary dilution steam stream to form a mixture, flashing the mixture to form a vapor phase and a liquid phase which collect as bottoms and removing the liquid phase, separating and cracking the vapor phase, and cooling the product effluent, wherein the bottoms are maintained under conditions to effect at least partial visbreaking. The visbroken bottoms may be steam stripped to recover the visbroken molecules while avoiding entrainment of the bottoms liquid. An apparatus for carrying out the process is also provided.

2 Claims, 3 Drawing Sheets

U.S. PATENT DOCUMENTS

| | | | | |
|---|---|---|---|---|
| 3,324,680 | A * | 6/1967 | Cremer | 62/473 |
| 3,341,429 | A | 9/1967 | Fondrk | 203/95 |
| 3,413,211 | A | 11/1968 | Becraft et al. | 208/93 |
| 3,487,006 | A | 12/1969 | Newman et al. | 208/93 |
| 3,492,795 | A | 2/1970 | Guerrieri | 55/463 |
| 3,505,210 | A | 4/1970 | Wallace et al. | 208/228 |
| 3,617,493 | A | 11/1971 | Wirth et al. | 208/80 |
| 3,677,234 | A | 7/1972 | Dutkiewicz | 122/240 |
| 3,718,709 | A | 2/1973 | Simonetta | 260/683 R |
| 3,900,300 | A | 8/1975 | Lehman | 55/184 |
| 4,199,409 | A | 4/1980 | Skraba | 203/39 |
| 4,264,432 | A | 4/1981 | Gartside | 208/48 R |
| 4,300,998 | A | 11/1981 | Gartside | 208/127 |
| 4,311,580 | A | 1/1982 | Bartholic | 208/91 |
| 4,361,478 | A | 11/1982 | Gengler et al. | 208/130 |
| 4,400,182 | A | 8/1983 | Davies et al. | 48/214 |
| 4,426,278 | A | 1/1984 | Kosters | 208/130 |
| 4,543,177 | A | 9/1985 | Murthy et al. | 208/130 |
| 4,615,795 | A | 10/1986 | Woebcke et al. | 208/72 |
| 4,714,109 | A | 12/1987 | Tsao | 165/104.18 |
| 4,732,740 | A | 3/1988 | Woebcke et al. | 422/193 |
| 4,840,725 | A | 6/1989 | Paspek | 208/130 |
| 4,854,944 | A | 8/1989 | Strong | 48/214 R |
| 4,954,247 | A | 9/1990 | Lipkin et al. | 208/355 |
| 5,096,567 | A | 3/1992 | Paspek, Jr. et al. | 208/106 |
| 5,120,892 | A | 6/1992 | Skraba | 585/652 |
| 5,190,634 | A | 3/1993 | Fernandez-Baujin et al. | 208/107 |
| 5,468,367 | A | 11/1995 | Dickakian | 208/48 |
| 5,580,443 | A | 12/1996 | Yoshida et al. | 208/130 |
| 5,817,226 | A | 10/1998 | Lenglet | 208/130 |
| 5,910,440 | A | 6/1999 | Grossman et al. | 435/282 |
| 6,093,310 | A | 7/2000 | Swan | 208/113 |
| 6,123,830 | A | 9/2000 | Gupta et al. | 208/76 |
| 6,179,997 | B1 | 1/2001 | Vedder, Jr. et al. | 208/113 |
| 6,190,533 | B1 | 2/2001 | Bradow et al. | 208/57 |
| 6,210,561 | B1 | 4/2001 | Bradow et al. | 208/89 |
| 6,303,842 | B1 | 10/2001 | Bridges et al. | 585/648 |
| 6,376,732 | B1 | 4/2002 | Ngan et al. | 585/800 |
| 6,632,351 | B1 | 10/2003 | Ngan et al. | 208/132 |
| 6,743,961 | B2 | 6/2004 | Powers | 585/648 |
| 2001/0016673 | A1 | 8/2001 | Bridges et al. | 585/648 |
| 2003/0070963 | A1 | 4/2003 | Zimmermann et al. | 208/106 |
| 2004/0004022 | A1 | 1/2004 | Stell et al. | 208/106 |
| 2004/0004027 | A1 | 1/2004 | Spicer et al. | 208/130 |
| 2004/0004028 | A1 | 1/2004 | Stell et al. | 208/130 |
| 2004/0039240 | A1 | 2/2004 | Powers | 585/652 |
| 2004/0054247 | A1 | 3/2004 | Powers | 585/652 |
| 2005/0010075 | A1 | 1/2005 | Powers | 585/648 |
| 2005/0261536 | A1 * | 11/2005 | Stell et al. | 585/648 |
| 2006/0014993 | A1 * | 1/2006 | Stell et al. | 585/648 |
| 2006/0129012 | A1 * | 6/2006 | Frye et al. | 585/648 |
| 2006/0226048 | A1 * | 10/2006 | Stell et al. | 208/125 |
| 2007/0006733 | A1 * | 1/2007 | Stell et al. | 95/266 |
| 2007/0031306 | A1 * | 2/2007 | Stell | 422/189 |
| 2007/0031307 | A1 * | 2/2007 | Stell et al. | 422/189 |
| 2007/0160513 | A1 * | 7/2007 | Stell et al. | 422/194 |
| 2007/0215524 | A1 * | 9/2007 | Stell et al. | 208/184 |
| 2008/0118416 | A1 * | 5/2008 | Stell et al. | 422/207 |

FOREIGN PATENT DOCUMENTS

| | | |
|---|---|---|
| EP | 0063448 | 10/1982 |
| FR | 1472280 | 3/1967 |
| GB | 199766 | 6/1923 |
| GB | 998504 | 7/1965 |
| GB | 1053751 | 1/1967 |
| GB | 1203017 | 8/1970 |
| GB | 1233795 | 5/1971 |
| GB | 2006259 | 10/1977 |
| GB | 2012176 | 11/1977 |
| NL | 7410163 | 4/1975 |
| SU | 1491552 | 7/1989 |
| WO | WO 01/55280 | 8/2001 |
| ZA | 907394 | 7/1991 |

OTHER PUBLICATIONS

ABB Lummus Crest Inc., (presentation) HOPS, "Heavy Oil Processing System", Jun. 15, 1992 TCC PEW Meeting, pp. 1-18.

Mitsui Sekka Engineering Co., Ltd./Mitsui Engineering & Shipbuilding Co, Ltd., "Mitsui Advanced Cracker & Mitsui Innovative Quencher", pp. 1-16.

"Specialty Furnace Design: Steam Reformers and Steam Crackers", presented by T.A. Wells of the M.W. Kellogg Company, 1988 AiChe Spring National Meeting.

* cited by examiner

PROCESS AND APPARATUS FOR CRACKING HYDROCARBON FEEDSTOCK CONTAINING RESID

CROSS-REFERENCE TO RELATED APPLICATION

This application is a divisional application of U.S. patent application Ser. No. 10/851,486 filed May 21, 2004 now U.S. Pat. No. 7,220,887.

FIELD OF THE INVENTION

The present invention relates to the cracking of hydrocarbons that contain relatively non-volatile hydrocarbons and other contaminants. More particularly, the present invention relates to increasing the amounts of feed available to a steam cracker.

BACKGROUND

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace that has two main sections: a convection section and a radiant section. The hydrocarbon feedstock typically enters the convection section of the furnace as a liquid (except for light feedstocks which enter as a vapor) wherein it is typically heated and vaporized by indirect contact with hot flue gas from the radiant section and by direct contact with steam. The vaporized feedstock and steam mixture is then introduced into the radiant section where the cracking takes place. The resulting products comprising olefins leave the pyrolysis furnace for further downstream processing, including quenching.

Pyrolysis involves heating the feedstock sufficiently to cause thermal decomposition of the larger molecules. The pyrolysis process, however, produces molecules that tend to combine to form high molecular weight materials known as tar. Tar is a high-boiling point, viscous, reactive material that can foul equipment under certain conditions. In general, feedstocks containing higher boiling materials tend to produce greater quantities of tar.

Conventional steam cracking systems have been effective for cracking high-quality feedstock which contain a large fraction of light volatile hydrocarbons, such as gas oil and naphtha. However, steam cracking economics sometimes favor cracking lower cost feedstocks containing resids such as, by way of non-limiting examples, atmospheric residue, e.g., atmospheric pipestill bottoms, and crude oil. Crude oil and atmospheric residue often contain high molecular weight, non-volatile components with boiling points in excess of 590° C. (1100° F.). The non-volatile components of these feedstocks lay down as coke in the convection section of conventional pyrolysis furnaces. Only very low levels of non-volatile components can be tolerated in the convection section downstream of the point where the lighter components have fully vaporized.

In most commercial naphtha and gas oil crackers, cooling of the effluent from the cracking furnace is normally achieved using a system of transfer line heat exchangers, a primary fractionator, and a water quench tower or indirect condenser. The steam generated in transfer line exchangers can be used to drive large steam turbines which power the major compressors used elsewhere in the ethylene production unit. To obtain high energy-efficiency and power production in the steam turbines, it is necessary to superheat the steam produced in the transfer line exchangers.

Cracking heavier feeds, such as kerosenes and gas oils, produces large amounts of tar, which leads to rapid coking in the radiant section of the furnace as well as fouling in the transfer line exchangers preferred in lighter liquid cracking service.

Additionally, during transport some naphthas are contaminated with heavy crude oil containing non-volatile components. Conventional pyrolysis furnaces do not have the flexibility to process residues, crudes, or many residue or crude contaminated gas oils or naphthas which comprise non-volatile components.

To address coking problems, U.S. Pat. No. 3,617,493, which is incorporated herein by reference, discloses the use of an external vaporization drum for the crude oil feed and discloses the use of a first flash to remove naphtha as vapor and a second flash to remove vapors with a boiling point between 230 and 590° C. (450 and 1100° F.). The vapors are cracked in the pyrolysis furnace into olefins and the separated liquids from the two flash tanks are removed, stripped with steam, and used as fuel.

U.S. Pat. No. 3,718,709, which is incorporated herein by reference, discloses a process to minimize coke deposition. It describes preheating of heavy feedstock inside or outside a pyrolysis furnace to vaporize about 50% of the heavy feedstock with superheated steam and the removal of the residual, separated liquid. The vaporized hydrocarbons, which contain mostly light volatile hydrocarbons, are subjected to cracking.

U.S. Pat. No. 5,190,634, which is incorporated herein by reference, discloses a process for inhibiting coke formation in a furnace by preheating the feedstock in the presence of a small, critical amount of hydrogen in the convection section. The presence of hydrogen in the convection section inhibits the polymerization reaction of the hydrocarbons thereby inhibiting coke formation.

U.S. Pat. No. 5,580,443, which is incorporated herein by reference, discloses a process wherein the feedstock is first preheated and then withdrawn from a preheater in the convection section of the pyrolysis furnace. This preheated feedstock is then mixed with a predetermined amount of steam (the dilution steam) and is then introduced into a gas-liquid separator to separate and remove a required proportion of the non-volatiles as liquid from the separator. The separated vapor from the gas-liquid separator is returned to the pyrolysis furnace for heating and cracking.

Co-pending U.S. application Ser. No. 10/188,461 filed Jul. 3, 2002, Patent Application Publication US 2004/0004022 A1, published Jan. 8, 2004, which is incorporated herein by reference, describes an advantageously controlled process to optimize the cracking of volatile hydrocarbons contained in the heavy hydrocarbon feedstocks and to reduce and avoid coking problems. It provides a method to maintain a relatively constant ratio of vapor to liquid leaving the flash by maintaining a relatively constant temperature of the stream entering the flash. More specifically, the constant temperature of the flash stream is maintained by automatically adjusting the amount of a fluid stream mixed with the heavy hydrocarbon feedstock prior to the flash. The fluid can be water.

In using a flash to separate heavy liquid hydrocarbon fractions containing resid from the lighter fractions which can be processed in the pyrolysis furnace, it is important to effect the separation so that most of the non-volatile components will be in the liquid phase. Otherwise, heavy, coke-forming non-volatile components in the vapor are carried into the furnace causing coking problems.

Increasing the cut in the flash drum, or the fraction of the hydrocarbon that vaporizes, is also extremely desirable because resid-containing liquid hydrocarbon fractions generally have a low value, often less than heavy fuel oil. Vaporizing some of the heavier fractions produces more valuable steam cracker feed. This can be accomplished by increasing the flash drum temperature to increase the cut. However, the resulting vaporized heavier fractions tend to partially condense in the overhead vapor phase resulting in fouling of the lines and vessels downstream of the flash/separation vessel overhead outlet.

Accordingly, it would be desirable to provide a process for converting materials in the liquid phase in the drum to materials suitable as non-fouling components for the vapor phase.

SUMMARY

In one aspect, the present invention relates to a process for cracking hydrocarbon feedstock containing resid comprising: heating the feedstock, mixing the heated feedstock with a fluid and/or a primary dilution steam stream to form a mixture, flashing the mixture to form a vapor phase and a liquid phase which collect as bottoms and removing the liquid phase, separating and cracking the vapor phase, and cooling the product effluent, wherein the bottoms are maintained under conditions to effect at least partial visbreaking. In an embodiment, the mixture can be further heated prior to flashing.

In another aspect, the present invention relates to a process for cracking hydrocarbon feedstock containing resid which comprises: (a) heating the hydrocarbon feedstock; (b) mixing the heated hydrocarbon feedstock with steam to form a mixture stream; (c) flashing the mixture stream to form a vapor phase overhead and a liquid phase which collects as bottoms; (d) maintaining the bottoms under conditions sufficient to effect at least partial visbreaking of the bottoms to provide lower boiling hydrocarbons; (e) removing the bottoms; (f) cracking the vapor phase to produce an effluent comprising olefins; (g) quenching the effluent; and (h) recovering cracked product from the quenched effluent.

In yet another aspect, the present invention relates to a vapor/liquid separation apparatus for treating a flow of vapor/liquid mixtures of hydrocarbons and steam, comprising: (a) a substantially cylindrical vertical drum having an upper cap section, a middle section comprising a circular wall, and a lower cap section; (b) an overhead vapor outlet extending upwardly from the upper cap section; (c) at least one inlet in the circular wall of the middle section for introducing the flow; (d) a substantially concentrically positioned, substantially cylindrical boot extending downwardly from the lower cap section for receiving separated liquid, the boot being of less diameter than the middle section and communicating with the lower cap section, and further comprising a liquid outlet at its lower end; and further comprising at least one of (e) a means for introducing heat directly to the lower cap section and/or the boot; and (f) a means to regulate residence time of liquid present in the lower cap and/or the boot.

In still yet another aspect, the present invention relates to an apparatus for cracking a hydrocarbon feedstock containing resid, comprising: (a) a heating zone for heating the hydrocarbon feedstock to provide heated hydrocarbon feedstock; (b) a mixing zone for mixing a primary dilution steam stream with the heated hydrocarbon feedstock to provide a heated two-phase stratified open channel flow mixture stream; (c) a vapor/liquid separation zone for treating vapor/liquid mixtures of hydrocarbons and steam, the zone comprising: i) a substantially cylindrical vertical drum having an upper cap section, a middle section comprising a circular wall, and a lower cap section; ii) an overhead vapor outlet extending upwardly from the upper cap section; iii) at least one inlet in the circular wall of the middle section for introducing the flow; iv) a substantially concentrically positioned, substantially cylindrical boot extending downwardly from the lower cap section for receiving separated liquid, the boot being of less diameter than the middle section and communicating with the lower cap section, and further comprising a liquid outlet at its lower end; and further comprising at least one of v) a means for introducing heat directly to the lower cap section and/or the boot; and vi) a means to regulate residence time of liquid present in the lower cap and/or boot; (d) a pyrolysis furnace comprising a convection section, and a radiant section for cracking the vapor phase from the overhead vapor outlet to produce an effluent comprising olefins; (e) a means for quenching the effluent; and (f) a recovery train for recovering cracked product from the quenched effluent.

DETAILED DESCRIPTION

Figure 1:
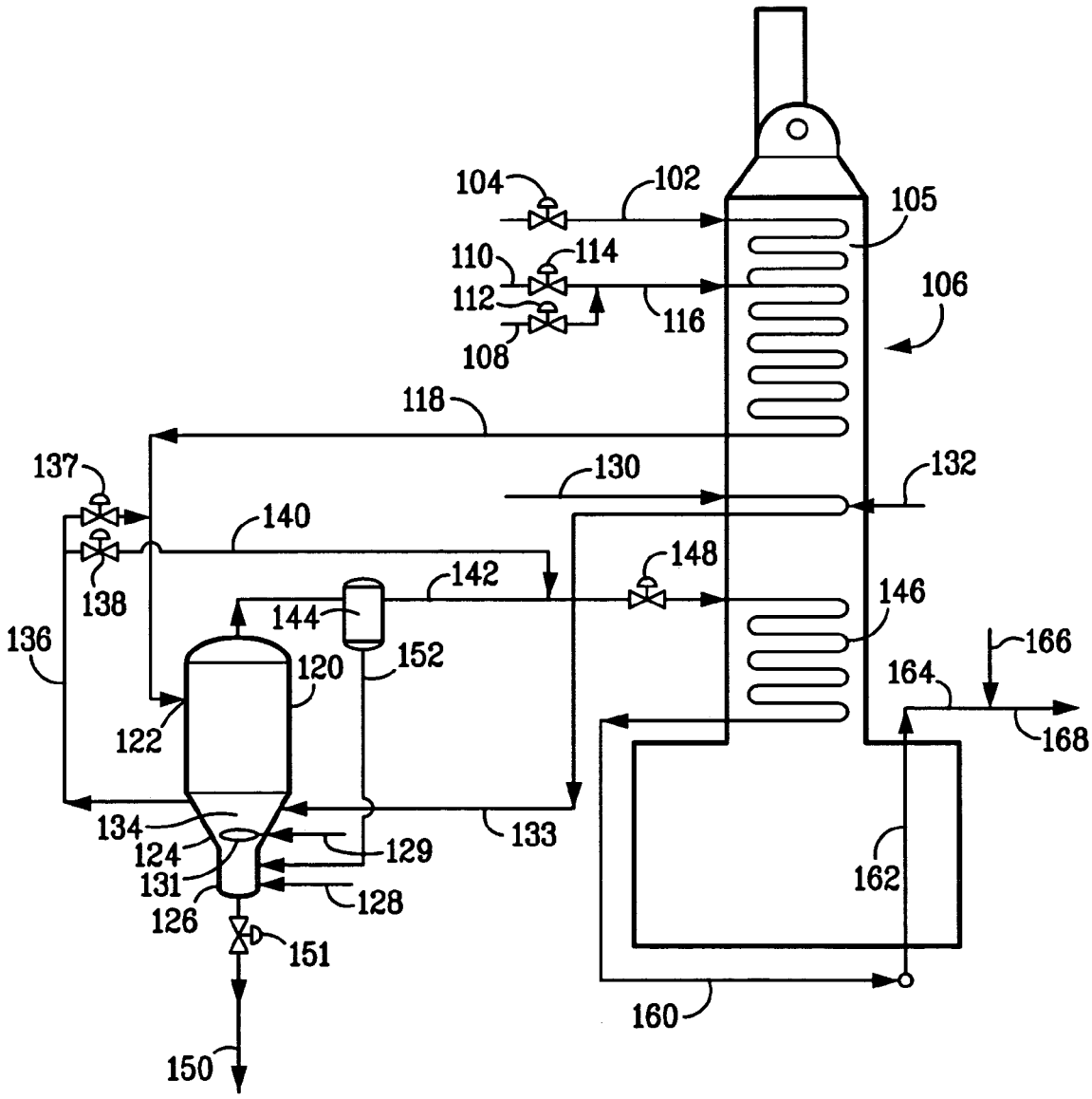
FIG. 1 illustrates a schematic flow diagram of a process in accordance with the present invention employed with a flash drum bottoms heater.

Visbreaking is a well-known mild thermal cracking process to which heavy hydrocarbonaceous oils may be heat soaked to reduce their viscosity by cracking in the liquid phase. See, for example, Hydrocarbon Processing, September 1978, page 106. Visbreaking occurs when a heavy hydrocarbon, or resid, is heat soaked at high temperature, generally from about 427 to about 468° C. (800 to 875° F.), for several minutes. Some of the resid molecules crack or break producing less viscous resid. Raising the liquid level in the flash/separation apparatus increases residence time to increase conversion of the resid.

While lighter visbroken molecules vaporize without additional processing, steam stripping may be necessary to vaporize heavier visbroken molecules. The visbreaking reactions are rapid enough that purge steam may be added to the flash drum to strip the visbroken molecules. This increases the fraction of the hydrocarbon vaporizing in the flash drum. Heating may also be used to increase resid conversion.

Visbreaking can be controlled by modifying the residence times of the liquid phase within the flash/separation apparatus. In one embodiment, the liquid phase level may be raised to fill the head of the flash drum, thus increasing residence time of the resid molecules to an extent sufficient to effect at least partial visbreaking. The addition of heat accelerates visbreaking in the liquid phase which collects as bottoms in the lower portion of the flash/separator vessel. In one embodiment of the present invention, a heater in the lower section of a flash drum is used in conjunction with the convection section of a steam cracking furnace, to provide the needed heat. The added heat keeps the resid hot enough to effect significant visbreaking conversion.

Quenching the effluent leaving the pyrolysis furnace may be carried out using a transfer line exchanger, wherein the amount of the fluid mixed with the hydrocarbon feedstock is varied in accordance with at least one selected operating parameter of the process. The fluid can be a hydrocarbon or water, preferably water.

In an embodiment of the present invention, the mixture stream is heated to vaporize any water present and at least partially vaporize hydrocarbons present in the mixture stream. Additional steam can be added to the mixture stream after the mixture stream is heated.

In one embodiment, water is added to the heated hydrocarbon feedstock prior to the flashing.

In an embodiment, the mixture stream is further heated, e.g., by convection heating, prior to the flashing.

In another embodiment, the conditions for effecting at least partial visbreaking of the bottoms comprise maintaining sufficient residence times for the bottoms prior to their removal. Such residence times can be controlled by adjusting the level of the bottoms in the flash vessel or flash drum.

In an embodiment of the present invention, the conditions for effecting at least partial visbreaking of the bottoms comprise introducing additional heat to the bottoms. Typically, the additional heat is introduced to the bottoms by contacting the bottoms with at least one heating coil, although any other suitable method known to those of skill in the art can be used. For present purposes, a heating coil need not be limited in shape to a coil, but can be of any suitable shape sufficient to impart the heat required by the process of the present invention, e.g., serpentine, parallel with end manifolds, etc. The heating coil typically comprises a tube with a heat exchange medium within the tube, e.g., the at least one heating coil contains steam, preferably superheated, as heat exchange medium. Steam can be introduced to the heating coil at a temperature of at least about 510° C. (950° F.), e.g., at an initial temperature of about 540° C. (1000° F.). The steam loses heat within the flash drum and is withdrawn from the heating coil at a lower temperature, say, e.g., from about 10 to about 70° C. (20 to about 125° F.) lower, e.g., about 40° C. (72° F.) lower. The steam can be obtained by any suitable source, e.g., by convection heating of at least one of water and steam. The steam is typically heated in a convection section of the furnace and passed to the heating coil. After passage through the heating coil(s), the discharged steam is withdrawn from the bottoms section and routed to a point within the flash drum above the bottoms section or is mixed with the steam/hydrocarbon mixture that is flowing to the vapor/liquid separation apparatus (flash drum separator).

In another embodiment of the present invention, the at least one coil is located in an elliptical head in the lower portion of a flash drum wherein the flashing occurs.

In one embodiment, the at least one coil is located in a conical section in the lower portion of a flash drum wherein the flashing occurs. The bottoms are typically removed as a downwardly plug flowing pool.

Conditions are maintained within the vapor/liquid separation apparatus so as to maintain the liquid bottoms at a suitable temperature, typically, of at least about 427° C. (800° F.), e.g., at a temperature ranging from about 427 to about 468° C. (800 to 875° F.).

In order to effect the desired partial visbreaking of the present invention, additional heat is added at a suitable rate, typically, a rate selected from at least one of about 0.3 MW (1 MBtu/hr) and at least about 0.3% of the furnace firing rate. Preferably, additional heat can be added at a rate selected from at least one of about 0.3 to about 0.6 MW (1 to 2 MBtu/hr), and about 0.3 to about 0.6% of the furnace firing rate. The added heat can effect sufficient partial visbreaking to convert at least about 25%, at least about 30%, or even at least about 40%, of resid in the bottoms to a 510° C.$^-$ (950° F.$^-$) fraction.

In one embodiment, the process of the present invention further comprises stripping the lower boiling hydrocarbons from the bottoms to provide additional vapor phase overhead. Such stripping is typically carried out with steam, e.g., stripping steam added at a rate ranging from about 18 to about 1800 kg/hr (40 to 4000 pounds/hr), say, a rate of about 900 kg/hr (2000 pounds/hr).

In another embodiment of the present invention, the at least one coil is located in an elliptical head in the lower portion of a flash drum wherein the flashing occurs.

In one embodiment, the apparatus of the present invention further comprises: an inlet for introducing stripping steam into the lower cap and/or the boot. The lower cap section can be of any suitable shape, typically, at least one of i) substantially hemispherical and ii) substantially semi-elliptical in longitudinal section.

The stripping steam is preferably added through a plurality of nozzles distributed in the lower cap or in the boot effecting good contact with the bottoms liquid and a velocity low enough to avoid entrainment of the bottoms liquid.

In another embodiment, the lower cap section of the apparatus is conical and can be advantageously pitched to an extent sufficient to provide downward plug flow of the separated liquid.

In an embodiment, the apparatus of the present invention has a means to regulate the residence time of the liquid in the boot, which utilizes a control valve to regulate removal of the separated liquid from the boot. Preferably, the means to regulate the residence time comprises a means to provide a liquid level within the boot and above the boot within the lower cap.

The apparatus of the present invention typically comprises at least one inlet in the circular wall of the middle section for introducing the flow that is a radial inlet, or more preferably, a substantially tangential inlet for introducing the flow along the wall. The flow is nearly straight down the wall to the lower cap. The means for introducing heat can be a heat-conducting coil mounted in the lower cap section and/or the boot which contains a heat carrying medium so that liquid adjacent the outside of the coil is heated. Any suitable heat carrying medium can be used, preferably steam.

In one embodiment, the apparatus comprises a tubular member or coil made of a material which permits efficient heat exchange, e.g., metal. The coil is advantageously substantially planar in shape and horizontally mounted, thus providing for the advantageous locating of the heating coil within the vapor/liquid separation apparatus. The coil can be continuous and comprised of alternating straight sections and 180° bend sections beginning with a straight inlet section and terminating in a straight outlet section, or alternately, the coil comprises a substantially straight inlet communicating with an inlet manifold substantially perpendicular to the straight inlet, at least two parallel tubes substantially perpendicular to and communicating with the inlet manifold and substantially perpendicular to and communicating with an outlet manifold, and a substantially straight outlet perpendicular to and communicating with the outlet manifold. Typically, the coil is of sufficient diameter to effect a moderate pressure drop. In one embodiment, the coil has a diameter ranging from about 2.5 to about 15 cm (1 to 6 in), e.g., a diameter of about 10 cm (4 in).

In one embodiment, the apparatus comprises two or more sets of the coil, one above the other(s).

In another embodiment, the apparatus of the present invention comprises a boot which comprises several internal modifications for improved operation. The boot can further comprise at least one of an inlet for quench oil, and a side inlet for introducing fluxant which can be added to control the viscosity of the liquid in the boot.

In applying this invention, the hydrocarbon feedstock containing resid may be heated by indirect contact with flue gas in a first convection section tube bank of the pyrolysis furnace before mixing with the fluid. Preferably, the temperature of the hydrocarbon feedstock is from 150 to 260° C. (300 to 500° F.) before mixing with the fluid.

The mixture stream may then be further heated by indirect contact with flue gas in a first convection section of the pyrolysis furnace before being flashed. Preferably, the first convection section is arranged to add the fluid, and optionally primary dilution steam, between rows of that section such that the hydrocarbon feedstock can be heated before mixing with the fluid and dilution steam and then the mixture stream typically can be further heated before being flashed.

The temperature of the flue gas entering the first convection section tube bank is generally less than about 815° C. (1500° F.), for example, less than about 700° C. (1300° F.), such as less than about 620° C. (1150° F.), and preferably less than about 540° C. (1000° F.).

Dilution steam may be added at any point in the process, for example, it may be added to the hydrocarbon feedstock containing resid before or after heating, to the mixture stream, and/or to the vapor phase. Any dilution steam stream may comprise sour steam. Any dilution steam stream may be heated or superheated in a convection section tube bank located anywhere within the convection section of the furnace, preferably in the first or second tube bank.

The mixture stream may be at about 315 to about 540° C. (600° F. to 1000° F.) before the flash in step (c), and the flash pressure may be about 275 to about 1375 kPa (40 to 200 psia). Following the flash, 50 to 98% of the mixture stream may be in the vapor phase. An additional separator such as a centrifugal separator may be used to remove trace amounts of liquid from the vapor phase. The vapor phase may be heated to above the flash temperature before entering the radiant section of the furnace, for example, from about 425 to about 705° C. (800 to 1300° F.). This heating may occur in a convection section tube bank, preferably the tube bank nearest the radiant section of the furnace.

Unless otherwise stated, all percentages, parts, ratios, etc. are by weight. Ordinarily, a reference to a compound or component includes the compound or component by itself, as well as in combination with other compounds or components, such as mixtures of compounds.

Further, when an amount, concentration, or other value or parameter is given as a list of upper preferable values and lower preferable values, this is to be understood as specifically disclosing all ranges formed from any pair of an upper preferred value and a lower preferred value, regardless of whether ranges are separately disclosed.

As used herein, non-volatile components are the fraction of the hydrocarbon feed with a nominal boiling point above 590° C. (1100° F.) as measured by ASTM D-6352-98 or D-2887. This invention works very well with non-volatiles having a nominal boiling point above 760° C. (1400° F.). The boiling point distribution of the hydrocarbon feed is measured by Gas Chromatograph Distillation (GCD) by ASTM D-6352-98 or D-2887 extended by extrapolation for material boiling above 700° C. (1292° F.). Non-volatiles include coke precursors, which are large, condensable molecules which condense in the vapor, and then form coke under the operating conditions encountered in the present process of the invention.

The hydrocarbon feedstock can comprise a large portion, such as about 5 to about 50%, of non-volatile components, i.e., resid. Such feedstock could comprise, by way of non-limiting examples, one or more of steam cracked gas oils and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, C4's/residue admixture, naphtha/residue admixture, hydrocarbon gases/residue admixture, hydrogen/residue admixtures, gas oil/residue admixture, and crude oil.

The hydrocarbon feedstock can have a nominal end boiling point of at least about 315° C. (600° F.), generally greater than about 510° C. (950° F.), typically greater than about 590° C. (1100° F.), for example greater than about 760° C. (1400° F.). The economically preferred feedstocks are generally low sulfur waxy residues, atmospheric residues, naphthas contaminated with crude, various residue admixtures and crude oil.

In an embodiment of the present invention depicted in FIG. 1, hydrocarbon feed containing resid stream 102, e.g., atmospheric resid, controlled by feed inlet valve 104 is heated in an upper convection section 105 of a furnace 106. Then steam stream 108 and water stream 110, controlled by valves 112 and 114, respectively, are mixed through line 116 with the hydrocarbon in the upper convection section. The mixture is further heated in the convection section where all of the water vaporizes and a fraction of the hydrocarbon vaporizes.

Exiting upper convection section 105, the mixture stream 118, generally at a temperature of about 455° C. (850° F.) enters a vapor/liquid separation apparatus or flash drum 120 by a tangential inlet 122 where a vapor/liquid separation occurs. The vapor is at its dew point. The liquid resid falls to either an elliptical head (as shown in 327 of FIG. 3) or a conical bottom section 124 of the flash drum and into a cylindrical boot 126 where quench oil introduced via line 128 prevents excessive coking of the liquid bottoms. The flow pattern of the heated resid follows plug flow in the coned bottom section. Dead spots are generally infrequent in the downward flowing pool of liquid resid in the coned bottom section, preventing excess liquid residence time. In dead spots, coke can form due to severe but localized visbreaking reactions. The coned bottom section of the flash drum may have a steep pitch in order to maintain plug flow of the liquid resid. In one embodiment, visbreaking occurs in the conical bottoms pool, without a heater, provided sufficient residence time for the liquid bottoms is maintained. Steam may be directly injected into the liquid bottoms via line 129 and distributor 131 in the liquid phase to strip and agitate the pool of resid.

Additional dilution steam stream 130 is superheated in the convection section 106, desuperheated by water 132 and further heated in convection section 106 providing a 540° C. (1000° F.) steam stream and passed via line 133 to an inlet of steam heater 134 which comprises a heating coil. The cooled steam stream having a temperature of about 495° C. (925° F.) is discharged through an outlet of the steam heater via line 136. This discharged steam is further utilized by introduction via valve 137 to line 118 to vaporize additional hydrocarbon before the mixture in 118 enters flash drum 120 and/or by adding the discharged steam via control valve 138 and line 140 to the steam/hydrocarbon vapor 142 taken as an outlet from centrifugal separator 144, prior to further heating in a lower convection section 146, controlled by valve 148. Centrifugal separator bottoms are introduced via line 152 to the boot 126. Fluxant which reduces the viscosity of the partially visbroken liquid in the boot 126 can be added via line 152 taken from centrifugal separator 144.

Raising or maintaining the liquid level in the flash drum 120 to fill the bottom head of the drum before discharge through line 150 provides enough residence time to effect significant partial visbreaking of the resid liquid. A control valve 151 provides for regulating the amount of liquid bottoms withdrawn from the boot 126 for heat recovery and use as fuel oil. Reactor modeling predicts that 30% to 70% of resid from crude will be converted into molecules with boiling points less than 510° C. (950° F.). Steam stripping may be necessary to vaporize the visbroken molecules. But, the stripping steam bubbles (void space) will reduce the effective liquid residence time in the bottom head. A 45 kg/hr (100 lb/hr) steam purge will reduce the effective reside residence time by about 50% and resid conversion to only 23%. To counter this effect, as visbreaking is endothermic, mild heating of the resid increases conversion to 510° C. minus (950° F.) molecules.

In an embodiment of the invention, the liquid bottoms 150 can be recycled to another furnace with a separation drum, which is cracking a lighter feed, say HAGO or condensate. The lighter feed will completely vaporize upstream of the separation drum while vaporizing the 510° C.$^-$ (950° F.$^-$) in the recycle bottoms, providing additional feed to the radiant section.

The steam/hydrocarbon vapor derived from the flash drum overhead passes from the lower convection section 146 via crossover piping 160 through the radiant section 162 of the furnace and undergoes cracking. The cracked effluent exits the radiant section through line 164 and is quenched with quench oil 166 before further treatment by the recovery train 168.

Figure 2:
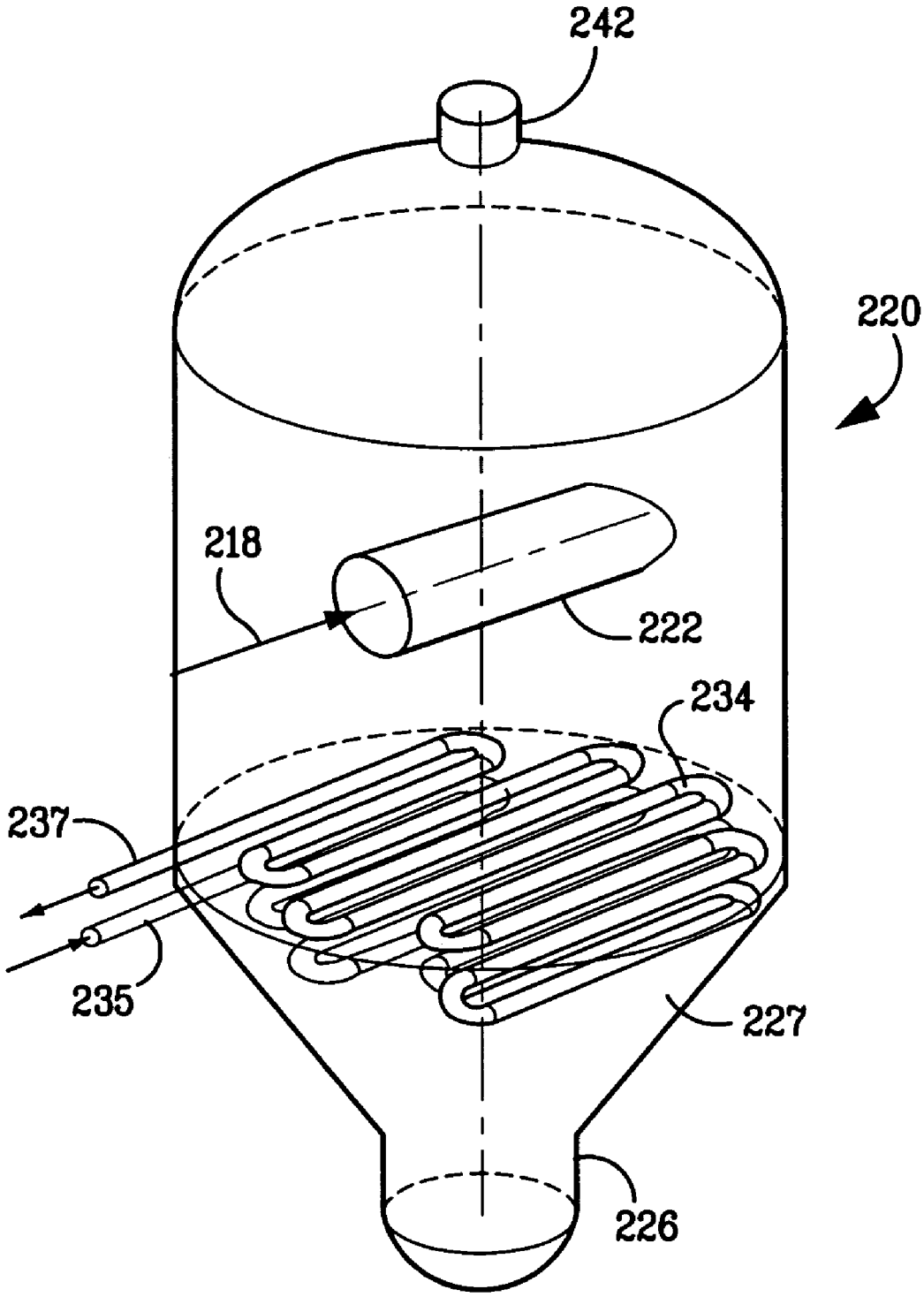
FIG. 2 illustrates a detailed perspective view of a flash drum with a conical bottom in accordance with one embodiment of the present invention.

FIG. 2 depicts a detailed view of a liquid/vapor separation or flash drum 220 with conical bottom section as used in an embodiment of the present invention. A hydrocarbon/steam mixture 218 to be flashed is introduced via tangential inlet 222. Based on a superheated steam flowrate of 1000 kg/hr (25000 lb/hr) the coil geometry of the steam heater 234 located in conic lower cap section 227, generally may be at least 2 rows in substantially parallel planes, each row having about 8 straight passes. The steam heater 234 which comprises a 10 cm (4 in) metal tube includes a steam inlet 235 for 540° C. (1000° F.) steam and a steam outlet 237 for 495° C. (925° F.) steam. The bare coil length is about 36 m (120 feet), which results in about 0.3 MW (1 MBtu/hr, 0.3% of furnace firing) of resid heating increasing resid conversion (to 510° C.$^-$ (950° F.$^-$) molecules) from 23 to 40%. A longer coil of about 70 m (230 ft) increases heating to 0.6 MW (2 MBtu/hr, 0.6% of firing) increasing conversion to about 60%. The exiting steam can then flow into the process entering the drum or into the overhead from centrifugal separator as noted in the description of FIG. 1. Vapor is removed as overhead from the drum via outlet 242.

Heating of resid allows for the use of purge stripping steam. Without purge steam, visbroken molecules may not vaporize. Removal of visbroken molecules also reduces the risk that visbroken resid will cause cavitation in bottoms pumps.

Figure 3:
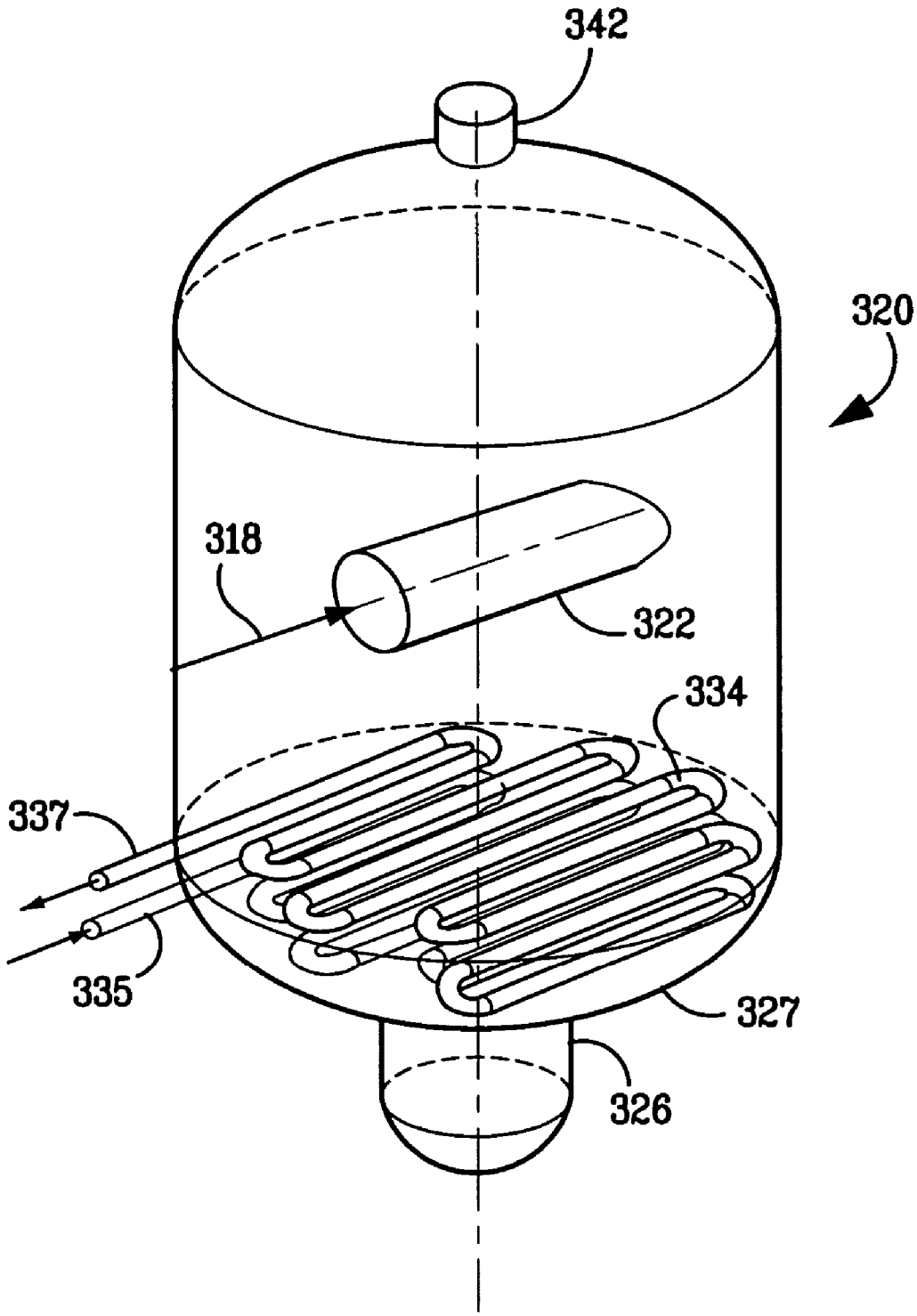
FIG. 3 depicts a detailed perspective view of a flash drum with a bottom section which is semi-elliptical in longitudinal section in accordance with one embodiment of the present invention.

FIG. 3 depicts a detailed view of a liquid/vapor separation or flash drum 320 with bottom section of semi-elliptical shape in longitudinal profile, as used in an embodiment of the present invention. A hydrocarbon/steam mixture 318 to be flashed is introduced via tangential inlet 322. Based on a superheated steam flowrate of 11000 kg/hr (25000 lb/hr) the coil geometry of the steam heater 334 located in elliptical lower cap section 327 generally may be at least 2 rows in substantially parallel planes, each row having about 8 straight passes. The steam heater 334 which comprises a 10 cm (4 in) metal tube includes a steam inlet 335 for 540° C. (1000° F.) steam and a steam outlet 337 for 495° C. (925° F.) steam. The exiting steam can flow into the process entering the drum or into the overhead from centrifugal separator as noted in the description of FIG. 1. Vapor is removed as overhead from the drum via outlet 342.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

We claim:

1. An apparatus for cracking a hydrocarbon feedstock comprising resid, comprising:

(a) a heating zone for heating said hydrocarbon feedstock to provide heated hydrocarbon feedstock;

(b) a mixing zone for mixing a primary dilution steam stream with said heated hydrocarbon feedstock to provide a heated two-phase stratified open channel flow mixture stream;

(c) a vapor/liquid separation zone for treating vapor/liquid mixtures of hydrocarbons and steam, said zone comprising:

i) a substantially cylindrical vertical drum having an upper cap section, a middle section comprising a circular wall, and a lower cap section;

ii) an overhead vapor outlet extending upwardly from said upper cap section;

iii) at least one inlet in the circular wall of said middle section for introducing said flow;

iv) a substantially concentrically positioned, substantially cylindrical boot extending downwardly from said lower cap section for receiving separated liquid, said boot being of less diameter than said middle section and communicating with said lower cap section, and further comprising a liquid outlet at its lower end; and further comprising at least one of v) a means for introducing heat directly to said lower cap section and/or said boot using at least one heating coil to provide conditions to effect at least partial visbreaking of the separated liquid; and vi) a means to regulate residence time of liquid present in said lower cap and/or boot to provide conditions to effect at least partial visbreaking of the separated liquid;

(d) a pyrolysis furnace comprising a convection section, and a radiant section for cracking the vapor phase from the overhead vapor outlet to produce an effluent comprising olefins;

(e) a means for quenching the effluent; and (f) a recovery train for recovering cracked product from the quenched effluent.

2. The apparatus of claim 1 which further comprises an additional heating zone between said mixing zone and said vapor/liquid separation zone.

* * * * *